US008001724B2

(12) United States Patent
Ponert et al.

(10) Patent No.: US 8,001,724 B2
(45) Date of Patent: Aug. 23, 2011

(54) ROTATING BARRIER

(75) Inventors: Gregor Ponert, Salzburg (AT); Thomas Grasmann, Gröding (AT)

(73) Assignee: Skidata AG, Gartenau (AT)

( * ) Notice: Subject to any disclaimer, the term of this patent is extended or adjusted under 35 U.S.C. 154(b) by 85 days.

(21) Appl. No.: 11/809,380

(22) Filed: Jun. 1, 2007

(65) Prior Publication Data

US 2007/0277439 A1 Dec. 6, 2007

(30) Foreign Application Priority Data

Jun. 6, 2006 (DE) ..... 10 2006 026 221

(51) Int. Cl.
*E01F 13/00* (2006.01)

(52) U.S. Cl. ..... 49/9; 49/34; 49/42

(58) Field of Classification Search ..... 49/9, 34, 49/42, 47, 49; 404/10
See application file for complete search history.

(56) References Cited

U.S. PATENT DOCUMENTS

| | | | | |
|---|---|---|---|---|
| 1,231,763 | A * | 7/1917 | Loprete | 160/185 |
| 1,628,651 | A * | 5/1927 | Burress | 49/9 |
| 1,939,968 | A * | 12/1933 | Frei, Jr. | 52/113 |
| 3,478,714 | A * | 11/1969 | Keats | 116/63 R |
| 3,731,929 | A * | 5/1973 | Landry | 473/576 |
| 4,636,109 | A * | 1/1987 | Clausen et al. | 404/10 |
| 5,293,716 | A * | 3/1994 | Rothschild | 49/49 |
| 6,370,821 | B1 * | 4/2002 | McCord et al. | 49/34 |
| 2006/0086516 | A1 * | 4/2006 | Saito | 173/162.2 |
| 2007/0001002 | A1 * | 1/2007 | Ponert et al. | 235/382 |

* cited by examiner

*Primary Examiner* — Gregory J. Strimbu
(74) *Attorney, Agent, or Firm* — Miller Canfield Paddock & Stone; Mark L. Maki

(57) ABSTRACT

A rotating barrier having a rotating arm assembly has at least one blocking arm which is formed at least over part of its length by a resiliently flexible core piece and is provided with an outer sheath.

17 Claims, 1 Drawing Sheet

ROTATING BARRIER

FIELD OF THE INVENTION

Figure 1:
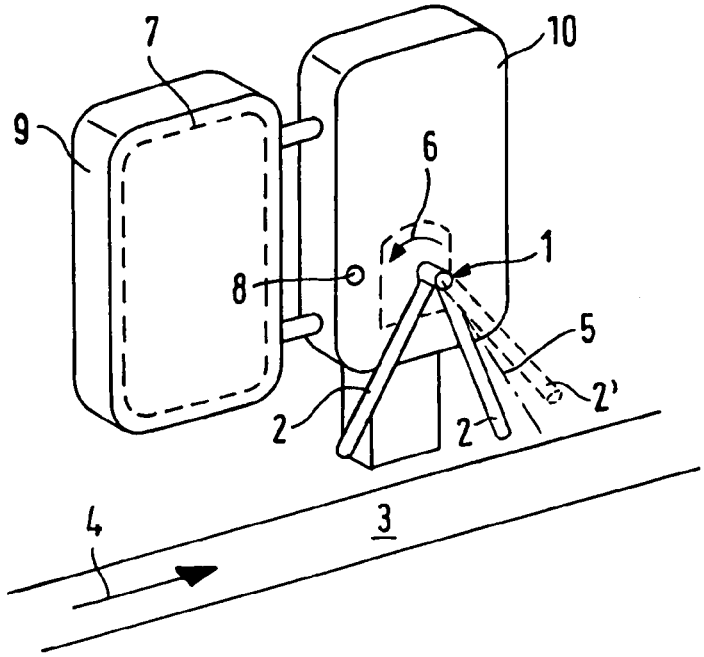

This invention relates to a rotating barrier for access control which has a rotating arm assembly provided with at least one flexibly formed blocking arm.

DESCRIPTION OF RELATED ART

Such a rotating barrier is known from DE 10 2004 013 965 B3. The blocking arm therein releases the access in its basic position, and the rotating arm assembly is actuated by a motor driven by a people sensor and an access authorization reader to rotate the blocking arm into the access so as to block it upon detection of a person but without valid reading of an access authorization.

When the blocking arm is rotated out of the basic or open-gate position into the blocking position because no valid access authorization has been read, a skier for example can hit the blocking element at high speed and thereby hurt himself. Accordingly, it is already provided according to DE 10 2004 013 965 B3 to equip the blocking arm with a padding and/or make it resilient, e.g. out of rubber-elastic material.

On the other hand, it must not be recognizable optically or in any other way that the blocking arm gives way, since this could otherwise destroy the actual purpose of the rotating barrier, namely to prevent unauthorized access.

It is therefore the problem of the invention to provide a blocking arm whose flexibility is only recognizable when collision with it would lead to injuries.

This is obtained according to the invention by the rotating barrier having a flexibly formed blocking arm. Advantageous embodiments of the invention are further rendered in additional features disclosed herein.

According to the invention, the flexibly formed blocking arm has a springy core piece extending at least over part of the length of the blocking arm. The springy core piece has such high spring stiffness that the blocking arm gives way only when a collision with a person produces forces that would lead to injury. This prevents the resilience of the blocking arm from being recognizable in normal operation, that is, when a person hits the blocking arm at normal walking speed for example. Moreover, the blocking arm is provided with an outer sheath so as not to allow its flexible formation to be optically recognizable.

The springy core piece can be formed by an element made of rubber-elastic material and/or a spring.

The rubber-elastic element can be a circular, prism-shaped or otherwise formed rod made of rubber-elastic material. The spring can be formed by a helical spring and/or a springy, for example circular or prism-shaped rod. It is also possible to use for example a leaf spring if it is so disposed in the blocking arm as to bend upon collision with a person.

The springy core piece preferably has hinged-together bodies which are held together under tension by the rubber-elastic element and/or the spring. The bodies can be made of a hard, i.e. itself not rubber-elastic, plastic, for example polyurethane, polyamide, polyolefins and similar relatively hard polymers. The rubber-elastic element or the spring can be disposed on the outer side of the bodies, but the rubber-elastic element or the spring preferably extends in the longitudinal direction of the blocking arm through the hinged-together bodies. The rubber-elastic element can be made of a thermoplastic elastomer, for example on the basis of polyethylene.

To be hinged together, the bodies are preferably provided with projections engaging recesses, the body at one end of the springy core having a recess and at the other end a projection, while the middle bodies disposed therebetween are each provided with a recess and a projection.

The bodies are preferably of cylindrical form. The recesses can also be of cylindrical form, while the projections, for hinged movability of the bodies, taper slightly for example conically or in arched fashion from the particular body on which they are provided into the recess which they engage.

The force with which the bodies are braced is preferably adjustable. When a rubber-elastic element is used for bracing the bodies, the rubber-elastic element can be stretched accordingly for adjusting said force. The thus stretched rubber-elastic element is then fixed at both ends to the two bodies at the ends of the springy core for example with transverse bolts or pins.

When the springy core has a compression spring, a cable or similar traction means can be guided through the compression spring for adjusting the bracing of the bodies, each end of said cable being connected to a threaded rod onto which a nut is screwed for adjusting the compression of the compression spring, on which one or the other end of the compression spring is supported.

The outer sheath with which the blocking arm is provided is preferably made of foam rubber or another rubber-elastic foam material.

The rotating arm assembly is preferably rotated by a motor, in particular an electromotor. It can have one, two or more blocking arms. The rotating arm assembly can have a rotation axis inclined from the horizontal for example by about 30 to 40° e.g. with a single blocking arm or with two blocking arms enclosing an angle of about 120 or 240°, as known from WO 97/18379 or EP-A-961005, or a vertical rotation axis with one, two or more blocking arms according to WO 97/18379.

The inventive rotating barrier is suitable in particular for open-gate access control apparatuses having a rotating arm assembly with one or two blocking arms. The rotating arm assembly is moved here by a motor which is driven by a people sensor and an access authorization reader. When the people sensor detects a person and the access authorization reader at the same time reads a valid access authorization, the rotating arm assembly remains in its basic or open-gate position in which e.g. the one or both blocking arms release the access. However, when a person is detected by the people sensor without a valid reading of the access authorization having been carried out, the motor is driven and thus the, or one, blocking arm rotated into the access to block it.

The invention prevents for example a skier or other person who is approaching the blocking arm extending across the access at high speed from being injured by the force of the impact when no valid access authorization is read and thus the access suddenly blocked by the blocking element. For open-gate control apparatuses it is customary to use non-contact-type access authorization readers, in particular readers for RFID transponders with the access authorization stored thereon. The people sensor can be formed for example as an optoelectronic sensor.

However, the inventive rotating barrier is also suitable for conventional access control apparatuses in which a blocking arm of the rotating arm assembly blocks the access in the basic position and releases it only after a valid access authorization is read. Such access authorization apparatuses can be provided with a people sensor which detects a person located in the area of the blocking plane which the blocking arm barring the access assumes. When a valid access authorization has been read by the access authorization reader and the people sensor detects a person, the motor of the rotating barrier is driven and the access thus released. The rotating arm assembly is then rotated further to block the access again.

When such an access is formed for wheelchairs, it can happen that the blocking arm hits the person in the wheelchair from behind and hurts him upon further rotation of the rotating arm assembly. Since such an access is formed to be appropriately wide and thus the blocking arms have a corresponding length, considerable lever forces can moreover occur. The inventive formation of the blocking arm can also minimize the risk of injury in this case.

BRIEF DESCRIPTION OF THR DRAWINGS

Figure 2:
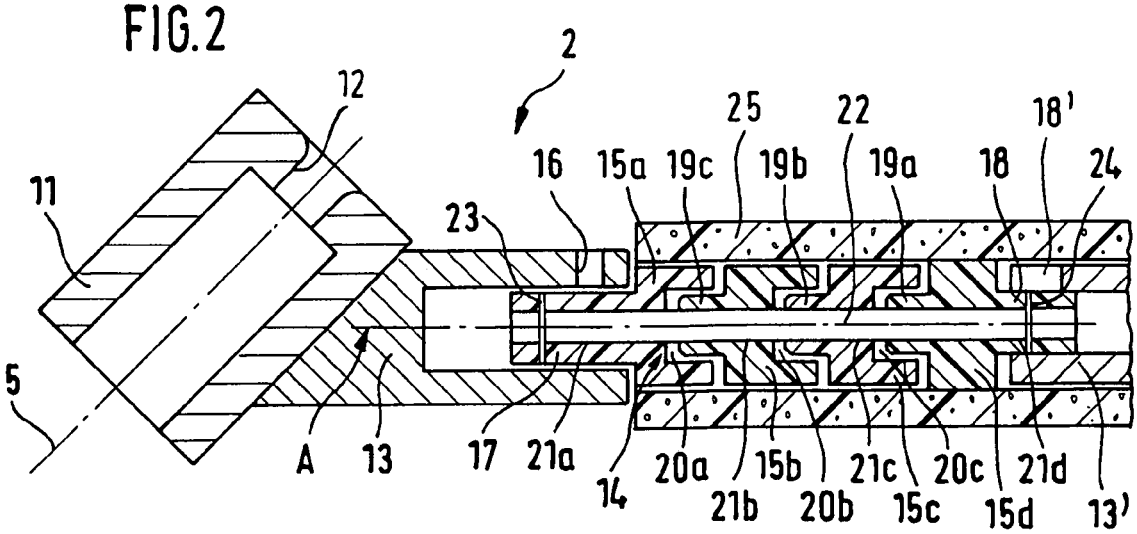
Figure 3:
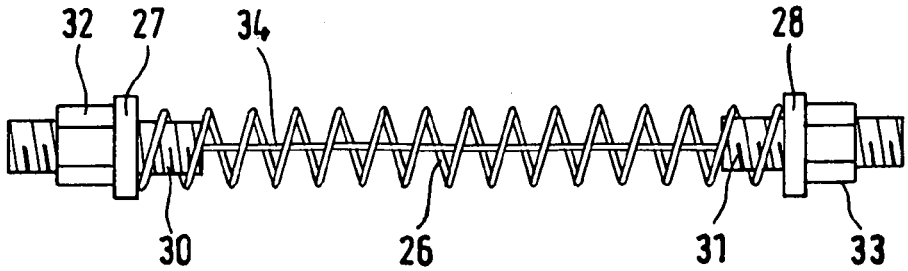

Hereinafter the invention will be explained in more detail by way of example with reference to the enclosed drawing. The figures are described as follows:

FIG. 1 a perspective view of an access control apparatus having a rotating arm assembly with two blocking arms;

FIG. 2 the part of the blocking arm facing the rotation axis of the rotating arm assembly according to FIG. 1 in longitudinal section;

FIG. 3 a side view of the elastic core piece of the blocking arm according to another embodiment but without hinged bodies and outer sheath.

DETAILED DESCRIPTION OF THE INVENTION

According to FIG. 1, an access control apparatus has a rotating arm assembly 1 with two blocking arms 2 for blocking the access lane 3 which is passed in the direction of the arrow 4. The rotating arm assembly 1 is rotatable around an axis 5 inclined e.g. by 35° from the horizontal. The blocking arms 2 enclose an angle of e.g. 45° with the rotation axis 5.

FIG. 1 shows the blocking arms 2 in the open-gate basic position in which it releases the access. Rotation of the rotating arm assembly 1 according to the arrow 6 causes a blocking arm 2 to be rotated upward into the position 2' shown by dashed lines in FIG. 1 and the access 3 thus blocked. The motor (not shown) of the rotating arm assembly 1 is driven for this purpose by an access authorization reader with an antenna 7 and a people sensor 8 in housings 9 and 10, respectively. The access authorization reader is formed for reading an access authorization which is stored on an RFID transponder. This means that the one blocking arm is rotated into the blocking position 2' only when the people sensor 8 detects a person but the access authorization reader does not read a valid access authorization.

According to FIG. 2, the blocking arm 2 is fastened to a hub 11 which is slipped rotationally fast on a shaft (not shown) for rotating the rotating arm assembly 1. For axially fastening the hub 11 to the shaft, a screw bolt (not shown) is provided which penetrates the bore 12. A tube section 13 is fastened to the hub 11. The hub 11 and the tube section 13 are made of metal and are welded together for example.

The short tube section 13 is followed by a springy core piece 14. The core piece 14 consists of hinged-together bodies 15*a* to 15*d*. The bodies 15*a* and 15*d* form the two ends of the core piece 4 between which the middle bodies 15*b* and 15*c* are disposed.

The body 15*a* has a cylindrical pin 17 which is inserted into the tube section 13 on the hub 11 and fixed with a screw (not shown) which penetrates the bore 16. Likewise, the body 15*d* is provided with a cylindrical pin 18 which is inserted into a further metal tube section (not shown) and fixed accordingly therein e.g. with a screw which penetrates the bore 18'.

For hinging together the bodies 15*a* to 15*d*, the body 15*d* and the middle bodies 15*b* and 15*c* have a projection 19*a* to 19*c* and the body 15*a* and each middle body 15*b* and 15*c* a recess 20*a* to 20*c*, the projections 19*a* to 19*c* engaging the recesses 20*a* to 20*c* of the adjacent body 15*a* to 15*d*.

The bodies 15*a* to 15*d* are made of plastic. They have a cylindrical circumferential area coaxial to the longitudinal axis A of the blocking arm 2. The recesses 20*a* to 20*c* are also formed substantially cylindrically and coaxially to the longitudinal axis A, while the projections 19*a* to 19*c* are likewise formed coaxially but taper away from the respective body 15*a* to 15*c*. For all bodies 15*a* to 15*d* to be aligned coaxially, the portion of the projections 19*a* to 19*c* facing the respective body 15*a* to 15*c* is provided with a diameter corresponding to the diameter of the recess 20*a* to 20*c* which it engages.

The bodies 15*a* to 15*d* are provided with coaxial through bores 21*a* to 21*d* having extending therethrough a rod-shaped element 22 made of rubber-elastic material, e.g. thermoplastic elastomer. The element 22 is stretched and fixed e.g. with pins 23, 24 to the end bodies 15*a* and 15*d* to brace the bodies 15*a* to 15*d* together.

An outer sheath 25 made of foam rubber is pushed over the springy or resiliently flexible core piece 14 and extends over tube section 13', partly shown in FIG. 2 and positioned at the end of the blocking arm 2 facing away or remote from the hub 11.

In the embodiment according to FIG. 3, the springy core piece 14 has instead of the rubber-elastic element 22 a compression spring 26 which extends through the through bores 21*a* to 21*d* of the bodies 15*a* to 15*d* not shown in FIG. 3. The compression spring 26 is supported at its ends on counterwashers 27, 28 which are each slipped on a threaded bolt 30, 31 and fixed by nuts 32, 33 screwed onto the threaded bolts 30, 31. The threaded bolts 30, 31 are interconnected by a cable 34 extending through the helical spring 26. At their ends onto which the nuts 32, 33 are screwed, the threaded bolts 30, 31 protrude out of the end bodies 15*a*, 15*d* to permit adjustment of the compression and thus the stiffness of the compression spring 26.

FIG. 2 shows only two middle bodies 15*b*, 15*c*. However, in reality more middle bodies are preferably used, for example three to eight. The length of the middle bodies 15*b*, 15*c* without projections 19*b*, 19*c* can be for example 0.5 to 3 cm.

The invention claimed is:

1. A rotating barrier having a rotating arm assembly with at least one flexible blocking arm, wherein the flexible blocking arm has opposite ends, an arm length defined between by said opposite ends and a resiliently flexible core piece having a core length extending at least over part of said arm length, wherein said core piece urges said blocking arm toward an elongate unflexed condition for blocking passage of an object through an access lane and permits resilient flexing of said blocking arm to a flexed condition in response to a collision of said blocking arm with the object in the access lane, said flexible blocking arm further being provided with a continuous flexible outer sheath enclosing said resiliently flexible core piece along said core length thereof to prevent recognition of the resilient flexibility of said blocking arm while permitting said resilient flexing of said blocking arm;

the resiliently flexible core piece comprising a resilient element which permits said resilient flexing of said blocking arm to said flexed condition and urges said arm toward said unflexed condition, the resiliently flexible core piece further comprising hinged-together monolithic core bodies which are drawn together by the resilient element, the core bodies each having at least one of a projection and a recess, the projection of one of said core bodies engaging the recess of an adjacent one of said core bodies to permit hinged articulation of said one of said core bodies relative to said adjacent one of said core bodies, the core body at one end of the resiliently flexible core piece having only said projection and the core body at the opposite end of the resiliently flexible core piece having only said recess and the core bodies disposed intermediately therebetween each having said projection and said recess which are fixed relative to said core body and hingedly engage adjacent said core bodies on opposite sides thereof.

2. The rotating barrier according to claim 1, wherein the resiliently flexible core piece is disposed between a rotation axis of the rotating arm assembly and an elongate central portion of the at least one blocking arm, wherein said central portion extends outwardly away from said resiliently flexible core piece.

3. The rotating barrier according to claim 1, wherein the resilient element is formed by a helical spring extending between the opposite ends of said flexible core piece.

4. The rotating barrier according to claim 3, wherein the helical spring is formed as a compression spring.

5. The rotating barrier according to claim 4, wherein a force is exerted by the compression spring to draw together the core bodies and said force is adjustable by varying a compression of the compression spring.

6. The rotating barrier according to claim 1, wherein the resilient element extends through the core bodies.

7. The rotating barrier according to claim 1, wherein a force is exerted by the resilient element to draw together the core bodies wherein said force is adjustable.

8. The rotating barrier according to claim 7, wherein said force is adjustable by stretching the resilient element.

9. The rotating barrier according to claim 1, wherein the outer sheath is made of rubber-elastic foam material.

10. A rotating barrier comprising a resiliently flexible blocking arm having an arm length, said blocking arm comprising:

a hub rotatable about a rotation axis;

an end tube section having inner and outer tube ends defining an end tube length, said end tube section projecting outwardly away from said hub to define a distal end of said blocking arm which said distal end is positionable within an access lane such that said blocking arm blocks passage through said access lane, said end tube section defining an outer portion of said arm length;

a resiliently flexible core piece having opposite core ends defining a length of said core piece wherein one of said core ends is connected to said hub and the other of said core ends is connected to said inner tube end of said end tube section, said core piece defining an inner portion of said arm length and being resiliently flexible between an unflexed condition enabling said blocking arm to block passage through said access lane and a flexed condition wherein said end tube section is displaced relative to said hub upon a collision with an object moving in said access lane, said core piece comprising a plurality of hingedly-connected core bodies, said core piece further including a resilient element extending through said core bodies and connected to said opposite core ends, said resilient element biasing ends which biases said core bodies into alignment to define said unflexed condition of said core piece and permits hinging movement of said core bodies out of alignment into said flexed condition of said core piece;

said plurality of said core bodies comprising first and second end core bodies at said opposite core ends and intermediate core bodies disposed adjacent to each other between said first and second end core bodies and each having opposite sides hingedly connected to adjacent said core bodies, said plurality of said core bodies including mating recesses and projections, wherein each said intermediate core body includes one said recess on one of said opposite sides thereof and one said projection on the other of said opposite sides thereof, and wherein one said recess is provided on one of said first and second end core bodies and one said projection is provided on the other of said first and second end core bodies, said recess and said projection of each of said intermediate core bodies being non-movably fixed thereto and being hingedly engaged respectively with said projection and said recess of said adjacent said core bodies on said opposite sides of said intermediate core body such that said core bodies are hingedly connected together in a row, wherein said hinging movement of said core bodies is permitted by the hinged engagement of said recesses of said core bodies with said projections of of said core bodies; and a continuous flexible outer sheath extending along said arm length so as to enclose said flexible core piece along said core length and enclose said end tube section along said end tube length, said outer sheath preventing recognition of a presence of said flexible core piece from an exterior of said blocking arm while permitting resilient flexing of said core piece.

11. The rotating barrier according to claim 10, wherein said second end core body is non-hingedly connected to said inner tube end.

12. The rotating barrier according to claim 11, wherein said resilient element has opposite element ends connected respectively to said first and second end core bodies to bias said plurality of said core bodies together while permitting said hinging movement of said core bodies relative to each other.

13. The rotating barrier according to claim 12, wherein said first and second end core bodies include respective first and second fixing structures in non-hingedly fixed engagement with said hub and said inner tube end of said end tube section, respectively such that said end tube section is movable together with said second end core body.

14. The rotating barrier according to claim 10, wherein said core bodies are monolithic.

15. A rotating barrier comprising a resiliently flexible blocking arm having an arm length, said blocking arm comprising:

a hub rotatable about a rotation axis;

a resiliently flexible core piece having opposite ends defining a core length of said core piece wherein one of said ends is connected to said hub and the other of said ends is disposed outwardly away from said hub, said core piece being resiliently flexible between an unflexed condition wherein said blocking arm is able to block passage through an access lane and a flexed condition wherein a portion of said blocking arm is displaced relative to said hub upon a collision with an object moving in said access lane, said core piece comprising a plurality of hingedly-connected monolithic core bodies;

said plurality of monolithic core bodies comprising first and second end core bodies each disposed at a respective one of said opposite ends wherein said first end core body is connected to said hub and said second end core body is spaced outwardly from said first end core body, and said plurality of monolithic core bodies further comprising intermediate core bodies disposed adjacent to each other between said first and second end core bodies and each having opposite sides hingedly connected to adjacent core bodies, said plurality of said core bodies including mating recesses and projections, wherein each said intermediate core body includes one said recess on one of said opposite sides thereof and one said projection on the other of said opposite sides thereof, and wherein one said recess is provided on one of said first and second end core bodies and one said projection is provided on the other of said first and second end core bodies, said recess and said projection of each of said intermediate core bodies being hingedly connected together respectively with said projection and said recess of said adjacent said core bodies on said opposite sides of said intermediate core body such that said core bodies are hingedly connected together in a row and permit hinging movement of said core bodies during flexing of said core piece between said unflexed and flexed conditions;

said core piece further including a resilient element extending through said core bodies between said opposite ends which biases said core bodies into alignment to define said unflexed condition of said core piece and permits said hinging movement of said core bodies out of alignment into said flexed condition of said core piece, said resilient element having opposite element ends connected respectively to said first and second end core bodies; and a continuous flexible outer sheath extending along said arm length so as to enclose said plurality of said core bodies of said flexible core piece, said outer sheath preventing recognition of a presence of said flexible core piece and said core bodies thereof from an exterior of said blocking arm while permitting resilient flexing of said core piece.

16. The rotating barrier according to claim 15, which includes an end tube section fixed to and projecting outwardly away from said second end core body to define a distal end of said blocking arm which is positionable within said access lane, said end tube section being non-hingedly fixed to said second end core body.

17. The rotating barrier according to claim 15, wherein said recess and said projection on each said intermediate core body are non-movably fixed to said intermediate core body.

* * * * *